US007839538B2

(12) United States Patent
Pauly et al.

(10) Patent No.: US 7,839,538 B2
(45) Date of Patent: Nov. 23, 2010

(54) METHOD AND SYSTEM FOR APPLYING AN IMAGE-DEPENDENT DYNAMIC WATERMARK TO POSTAL INDICIA

(75) Inventors: Steven J. Pauly, New Milford, CT (US); Bertrand Haas, New Haven, CT (US)

(73) Assignee: Pitney Bowes Inc., Stamford, CT (US)

( * ) Notice: Subject to any disclaimer, the term of this patent is extended or adjusted under 35 U.S.C. 154(b) by 1009 days.

(21) Appl. No.: 11/641,357

(22) Filed: Dec. 18, 2006

(65) Prior Publication Data

US 2008/0144116 A1 Jun. 19, 2008

(51) Int. Cl.
*H04K 1/00* (2006.01)

(52) U.S. Cl. ..... 358/3.28; 382/101

(58) Field of Classification Search ..... 358/3.28; 382/100, 101, 232; 713/176; 380/210, 287, 380/54, 55

See application file for complete search history.

(56) References Cited

U.S. PATENT DOCUMENTS

| | | | | |
|---|---|---|---|---|
| 5,513,563 | A | 5/1996 | Berson | 101/91 |
| 6,694,043 | B2 * | 2/2004 | Seder et al. | 382/100 |
| 7,006,656 | B2 | 2/2006 | Fridrich et al. | 382/100 |
| 7,013,024 | B2 | 3/2006 | Cordery et al. | 382/101 |
| 2002/0176114 | A1 | 11/2002 | Zeller et al. | 358/3.28 |
| 2003/0052178 | A1 | 3/2003 | Zeller et al. | 235/494 |
| 2003/0053653 | A1 | 3/2003 | Rhoads | 382/100 |
| 2005/0031160 | A1 * | 2/2005 | Shaked et al. | 382/100 |
| 2005/0114667 | A1 * | 5/2005 | Haas | 713/176 |
| 2006/0045306 | A1 | 3/2006 | Cordery et al. | 382/100 |

* cited by examiner

*Primary Examiner*—Andrew W Johns
(74) *Attorney, Agent, or Firm*—Bran A. Lemm; Angelo N. Chaclas

(57) ABSTRACT

Apparatus and method of creating and printing a postal indicium incorporating a dynamic, image-dependent watermark including receiving and storing a transformed image and metadata from an electronic device, inserting a watermark or portions of a watermark into the transformed image at one or more watermarking zones specified in the metadata, performing a transform on the transformed image with the watermark or portions of the watermark inserted therein to create a printing image, and printing the postal indicium wherein the postal indicium incorporates the printing image, a barcode and human readable text.

17 Claims, 3 Drawing Sheets

METHOD AND SYSTEM FOR APPLYING AN IMAGE-DEPENDENT DYNAMIC WATERMARK TO POSTAL INDICIA

FIELD OF THE INVENTION

The present invention relates to fraud prevention and in particular to a method of printing a postal indicium incorporating an image-dependent dynamic watermark to discourage forgery.

BACKGROUND OF THE INVENTION

The postal services of many countries around the world permit and/or require the printing of evidence of postage payment, such as a postal indicium, that includes a two-dimensional barcode. For example, the United States Postal Service has implemented a program known as the Information Based Indicia Program (IBIP) which permits a user to generate a postage indicium for sending a mailpiece (e.g., letter, package, etc.) that includes a human readable portion and a machine readable portion in the form of a two-dimensional barcode, such as without limitation, what is commonly referred to as a Data Matrix symbol. Such an indicium is commonly referred to as a Digital Postage Mark (DPM). In addition to encoding the value of the postage represented by such an indicium, the two-dimensional barcode often encodes other pieces of information concerning the mailpiece and/or the indicium, such as the date on which the indicium was printed, data concerning a characteristic and/or unique identifier of the printer used to print the indicium, an identifier of the sender and/or intended recipient, data concerning the location of the sender and/or intended recipient, an identifier that is assigned and is unique to each mailpiece, the weight of the mailpiece, and/or data concerning the size of the mailpiece.

Because the two-dimensional barcodes included in DPMs represent monetary value, and are thus a type of currency, it is tempting to fraudsters to copy a valid indicium having such a barcode and reuse it on other mailpieces. Even if a system of detection of duplicates is in place at the postal facilities (such as a system recording the barcodes going through and matching them against a database of all previously recorded barcodes), a number of ways of avoiding detection are possible. For example, the fraudster could send the illegitimate copy of the barcode first and the legitimate barcode afterward, making prosecution practically impossible. Alternatively, the fraudster could send all copies of the barcode at the same time from different locations so that the copies would be processed before the database is updated. Thus, it is desirable to protect such a postal indicium against copying.

One known way to protect an image, such as a postal indicium, against copying is to incorporate a watermark therein. A highly desirable form of watermark is an image-dependent dynamic watermark. Such a watermark is image-dependent in that the location at which the watermark is embedded into the image is dependent upon a characteristic of that image. Such a watermark is dynamic in that the content of the watermark, itself, is dependent upon data that is expected to change frequently, and perhaps as frequently as each time the watermark is embedded into an image. Unfortunately, considerable processing capability is needed either to process an image to determine where to embed a watermark therein to achieve image dependence, or to derive a new dynamic watermark each time the content of the watermark, itself, changes.

It is known to employ the processing capabilities built into a printer used to print postal indicia on mailpieces to incorporate a watermark into each printing of a postal indicium onto a mailpiece. However, the processing and data storage capabilities typically built into such a printer are usually limited by a need to produce such a printer at a minimal cost. As a result, it has become common practice to employ an image-independent fixed watermark in postal indicia generated within and printed by such printers. Such a watermark is image-independent in that the location at which the watermark is embedded into all images remains fixed, regardless of how an image changes or what image is used (e.g., always positioned around the center of any image, or always at given locations relative to a given corner of any image). Such a watermark is fixed in that the content of the watermark, itself, does not change such that the identical watermark is used, repeatedly. Although such a watermark accommodates the limited processing and data storage capabilities of typical printers used to print postal indicia, such a watermark more readily allows the indicia into which it is incorporated to simply be copied or scanned one time, and then recreated many times. Furthermore, improvements made in photocopying, printing and scanning equipment over time has made it easier to commit fraud by copying and reusing postal indicia, including watermarked postal indicia. Therefore, it would be desirable to be able to apply dynamic watermark information to printed images that are dependent upon the images without the necessity of significant processing power or memory in the printer device.

SUMMARY OF THE INVENTION

In one embodiment, the invention provides a method of creating and printing a postal indicium incorporating a watermark, including storing a transformed image in a storage of a printing device, storing metadata specifying at least one watermarking zone for the transformed image in the storage of the printing device, inserting in the printing device at least one portion of the watermark into the at least one watermarking zone of the transformed image, performing in the printing device a transformation of the transformed image with the at least one portion of the watermark inserted therein to create a printing image, and printing the postal indicium wherein the postal indicium incorporates the printing image, a barcode and a piece of human readable text.

The method may further include creating the watermark in the printer from at least one piece of information concerning the postal indicium, wherein the at least one piece of information changes each time a postal indicium is printed by the printing device. In one particular embodiment, the at least one piece of information is a time stamp indicating when a postal indicium is printed by the printing device.

In another embodiment, the invention provides a printing device to print a postal indicium incorporating a watermark, including a print engine, a storage having stored therein an inverse transform software, and a processor structured to store a transformed image in the storage, store metadata specifying at least one watermarking zone for the transformed image, insert at least one portion of the watermark into the at least one watermarking zone of the transformed image, perform a transformation of the transformed image with the at least one portion of the watermark inserted therein to create a printing image, and print the postal indicium wherein the postal indicium incorporates the printing image, a barcode and a piece of human readable text.

In another embodiment, the invention provides a machine-readable medium on which a sequence of instructions are stored that when executed by a processor causes the processor to perform operations including analyzing an original image to determine at least one watermarking zone, performing a transform on the original image to create transformed data, transmitting the transformed data to a printing device capable of inserting a watermark into the transformed data and performing an inverse transform on the transformed data; and transmitting a metadata to the printing device specifying the at least one watermarking zone.

In another embodiment, the invention provides a machine-readable medium on which a sequence of instructions are stored that when executed by a processor of a printing device causes the processor to perform operations including storing a transformed image received from an electronic device in a storage of the printing device, storing metadata received from an electronic device that specifies at least one watermarking zone for the transformed image in the storage of the printing device, inserting at least one portion of the watermark into the at least one watermarking zone of the transformed image, performing a transformation of the transformed image with the at least one portion of the watermark inserted therein to create a printing image, and printing the postal indicium wherein the postal indicium incorporates the printing image, a barcode and a piece of human readable text.

Therefore, it should now be apparent that the invention substantially achieves all the above aspects and advantages. Additional aspects and advantages of the invention will be set forth in the description that follows, and in part will be obvious from the description, or may be learned by practice of the invention. Moreover, the aspects and advantages of the invention may be realized and obtained by means of the instrumentalities and combinations particularly pointed out in the appended claims.

BRIEF DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

DESCRIPTION OF THE PREFERRED EMBODIMENTS

The present invention provides apparatus and a method of discouraging fraud arising from the duplication of postal indicia used to send mailpieces through the mail by incorporating a image-dependent dynamic watermark into postal indicia to enable identification of fraudulent duplicates of postal indicia.

Figure 1:
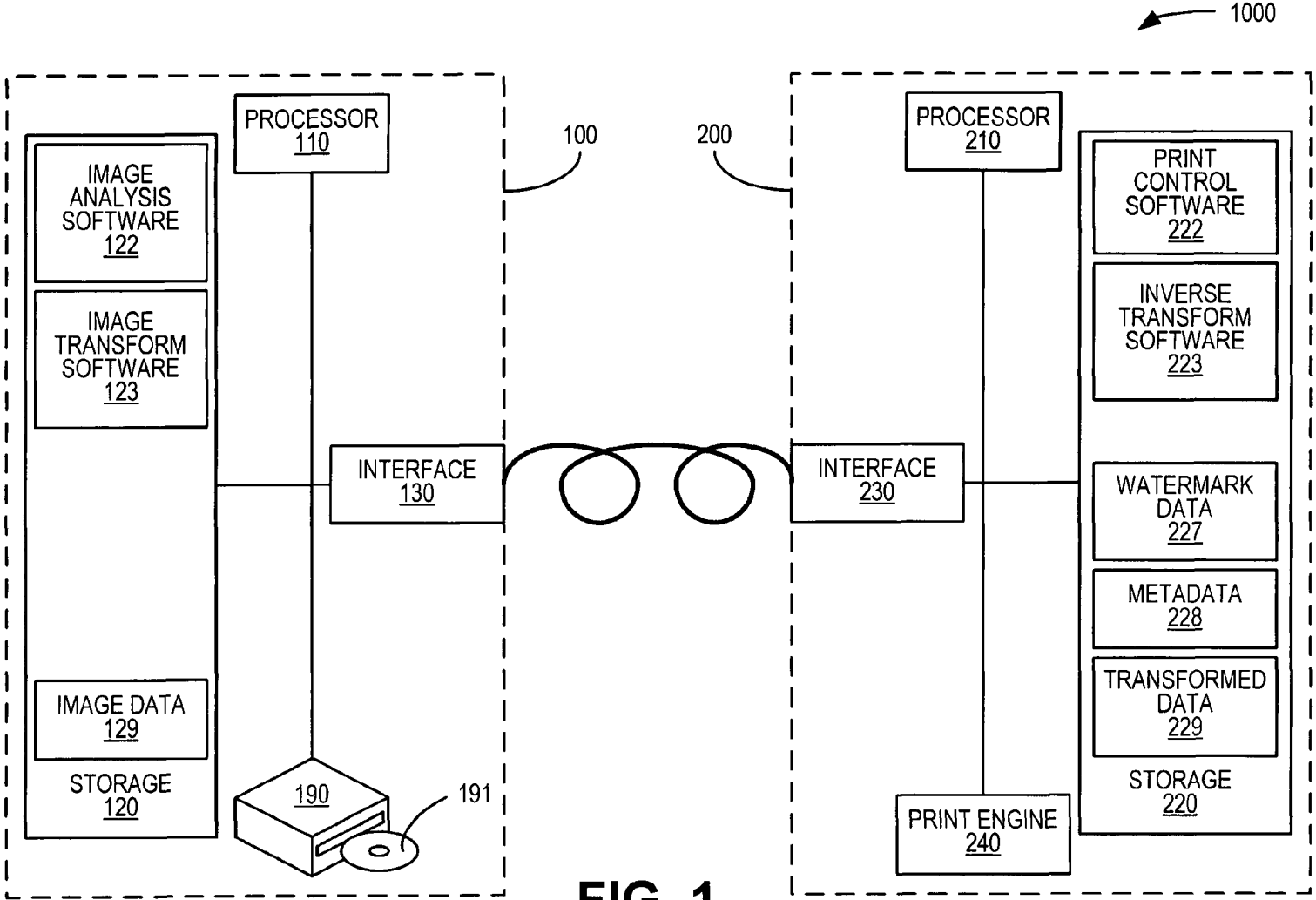
FIG. 1 illustrates an exemplary pair of devices to create and print a postal indicium.

FIG. 1 depicts a pair of devices 1000 that includes an electronic device 100 and a printing device 200. The electronic device 100 may be any of a variety of forms of computer system, including without limitation, a personal workstation or server. The electronic device 200 may be any of a variety of forms of printing device incorporating a print engine 240 to print postal indicia onto either mailpieces or onto labels to be affixed to mailpieces, including without limitation, a laser print engine, an inkjet print engine, a thermal print engine and/or dot-matrix impact print engine.

Electronic device 100 incorporates a processor 110 connected to a storage 120 and an interface 130. The processor 110 accesses the storage 120 to retrieve and execute sequences of instructions that make up software, such as an image analysis software 122 and an image transform software 123. The interface 130 provides an interface by which the electronic device 100 may be attached to the printing device 200. The printing device 200 incorporates a processor 210 connected to a storage 220, an interface 230 and the print engine 240. The processor 210 accesses the storage 220 to retrieve and execute sequences of instructions that make up software, such as a print control software 222 and a inverse transform software 223. The interface 230 provides an interface by which the electronic device 200 may be attached to the electronic device 100.

As those skilled in the art will readily recognize, the processors 110 and 210 may be of any of a wide variety of processing devices, including and without limitation, microcontrollers, microprocessors, sequencers, digital signal processors or state machines implemented in hardware logic. In some embodiments, one or both of the processors 110 and 210 may be one of a number of commercially available processors executing at least a portion of the widely known and used "X86" instruction set. Furthermore, the storages 120 and 220 may be of any of a wide variety of types of storage devices, including and without limitation, disk drives (e.g. and without limitation, hard drives, floppy drives, magneto-optical drives, magnetic tape drives or CD-ROM drives), solid state memory (e.g. and without limitation, static RAM, dynamic RAM, ROM, EEPROM or FLASH) and memory card readers. As previously discussed, the interfaces 130 and 230 allow the electronic device 100 and the printing device 200 to be attached to each other. This attachment may be through a direct electrical or optical connection, such as a digital parallel or digital serial interface (e.g., Universal Serial Bus), or through a network (e.g., Ethernet).

Furthermore, the electronic device 100 may also incorporate a media storage device 190 capable of interacting with a storage medium 191 (which may or may not be a form of removable media) to store and/or retrieve software and/or data. Alternatively, the media storage device 190 may be incorporated into the printing device 200. The software and/or data may include software stored in either storages 120 or 220, including without limitation, the image analysis software 122, the image transform software 123, the image data 129, the print control software 222, the inverse transform software 223, the watermark data 227, the metadata 228 and/or the transformed data 229.

Figure 2:
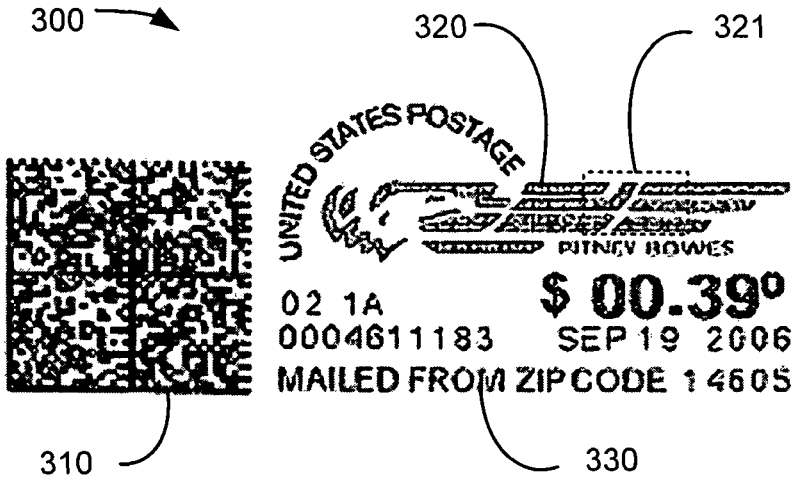
FIG. 2 illustrates an exemplary postal indicium created by the exemplary pair of devices of FIG. 1.

FIG. 2 depicts an exemplary postal indicium 300 created and printed by the pair of devices 1000 in a manner explained below. Within the indicium 300 is a two-dimensional barcode 310, an image 320, and human readable text 330. The barcode 310 encodes various pieces of information regarding the indicium 300 and/or a mailpiece (not shown) to which the indicium 300 is to be affixed, including without limitation, the amount of the postage represented by the indicium 300, the date on which the indicium 300 was printed, data concerning a characteristic and/or unique identifier of the printing device 200, an identifier of the sender and/or intended recipient, data concerning the location of the sender and/or intended recipient, an identifier that is assigned and is unique to each mailpiece, the weight of the mailpiece, and/or data concerning the size of the mailpiece. The image 320 may be any conceivable image, including without limitation, a company logo, a picture and/or a drawing. As will be explained, a human viewable portion of the image 320 is stored as a piece of image data 129 in the storage 120 of the electronic device 100, and is later combined with a piece of watermark data 227 stored in the storage 220 to create the image 320. The human readable text 330 provides in text form various pieces of information regarding the indicium 300 and/or the mailpiece to which the indicium 300 is to be affixed, including without limitation, the amount of postage represented by the indicium 300, the date on which the indicium 300 was printed, an identifier of the sender and/or the intended recipient, and/or data concerning the location of the sender and/or the intended recipient.

In executing a sequence of instructions of the image analysis software 122, the processor 110 prepares for the printing of the indicium 300 by retrieving the image data 129 from the storage 120 to analyze the image data 129 to locate one or more watermarking zones within the image stored as image data 129 at which at least a portion of the watermark stored as the watermark data 227 should be positioned to create the image 320, as exemplified by a watermarking zone 321 depicted with a dotted line box in FIG. 2. In some embodiments, the image analysis software 122 causes the processor 110 to perform one of a variety of possible transforms on the image data 129 (e.g., a Fourier, Laplace, Wavelet or other transform) to determine one or more watermarking zone locations based on one or more characteristics, such as without limitation, relative complexity of different locations within the image, relative gray shading levels, and/or relative overall light levels.

The processor 110 also executes a sequence of instructions of the image transform software 123 to prepare the image data 129 for later insertion of the watermark data 227. In some embodiments, the image transform software 123 causes the processor 110 to perform one of a variety of possible transforms on the image data 129 (e.g., a Fourier, Laplace, Wavelet or other transform) to convert the image data 129 into a form into which the watermark data 227 may be inserted. In some embodiments, the image analysis software 122 and the image transform software 123 may be a single combined piece of software and the same type of transform may be performed on the image data 129 to both locate watermarking zones and to prepare the image data 129 for subsequent insertion of the watermark data 227.

Regardless of whether the image analysis software 122 and the image transform software 123 are a single piece of software or separate pieces of software, considerable processing capability and storage capacity are required to execute the processing of the image data 129 just described. By employing the processor 110 of the electronic device 100 to carry out this processing, the processor 210 may be allowed to be a lower cost processor of lesser capability than the processor 110, and the storage 220 may be allowed to be of a smaller capacity than the storage 120.

After the image data 129 has been analyzed to locate one or more watermarking zones, and after the image data 129 has been prepared for subsequent insertion of the watermark data 227, the processor 110 is caused to operate the interface 130 to transmit the prepared form of the image data 129 to the printing device 200, where the processor 210 receives the prepared form of the image data 129 through the interface 230 and stores it as a piece of transformed data 229 in the storage 220. Similarly, the processor 110 is also caused to transmit metadata identifying the one or more watermarking zones located within the image data 129 to the printing device 200 where the processor 210 receives and stores it as a piece of metadata 228 in the storage 220.

At a time after receipt and storage of the transformed data 229 and the metadata 228, execution of the print control software 222 by the processor 210 causes the processor 210 to incorporate the watermark data 227 into the transformed data 229 at one or more of the watermarking zones specified in the metadata 228. Where more than one watermarking zone is specified, either all of the watermark data 227 may be incorporated into each watermarking zone, or the watermark data 227 may be divided into portions with a different portion being incorporated into each watermarking zone. The processor 210, in executing a sequence of instructions of the inverse transform software 223, prepares the resulting combination of the watermark data 227 and the transformed data 229 to create the image 320 to be printed as part of the indicium 300. In embodiments in which the processor 110 performed a transform on the image data 129 while executing the transform software 123, the inverse transform software 223 causes the processor 210 to perform an inverse transform (e.g., an inverse Fourier transform) that is the inverse of the transform earlier performed by the processor 110.

In some embodiments, the watermark data 227 encodes one or more of the pieces of information earlier discussed with reference to the barcode 310 and/or the human readable text 330. Indeed, in some of these embodiments, the watermark data 227 may be either a representation of the barcode 310 or may be derived from the barcode 310. Alternatively, the watermark data 227 and the barcode 310 may both be independently derived from the same pieces of information. As previously discussed, the watermark data 227 may represent a dynamic watermark, and therefore, at least one of the pieces of information from which the watermark data 227 is derived may be expected to change relatively more frequently than the other pieces of information, and perhaps, may change each time an indicium, such as the postal indicium 300, is printed by the printing device 200. At least some of these pieces of information may be stored in storages 120 and/or 220. In various embodiments, the watermark data 227 may be generated by the processor 110 of the electronic device 100 and/or may be generated by the processor 210 of the printing device 200. Similarly, the barcode 310 may be generated by one or both of the processors 110 and 210.

Further execution of a sequence of instructions of the print control software 222 by the processor 210 causes the processor 210 to operate the print engine 240 to print the postal indicium 300, incorporating the barcode 310, the image 320 and the human readable text 330. The postal indicium 300 may be printed either onto an envelope or other packaging of a mailpiece, directly, or onto a sticker or other adhesive label to be subsequently affixed to the mailpiece.

Figure 3:
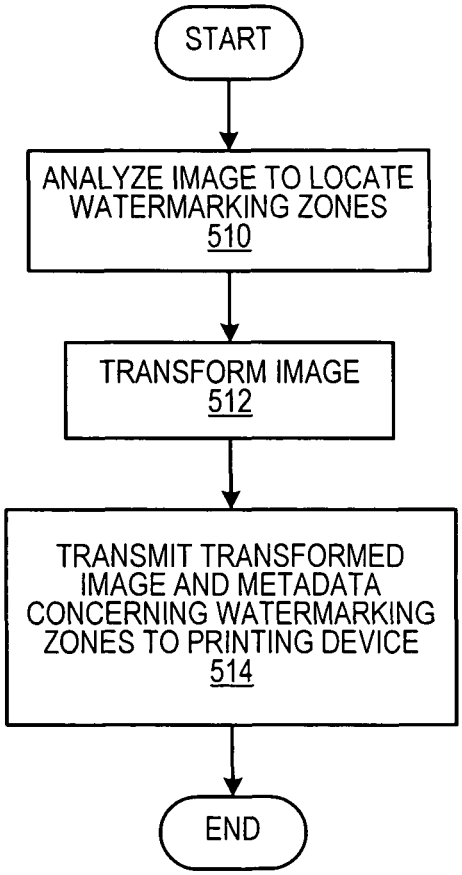
FIG. 3 is a flowchart of an embodiment of a method of creating a postal indicium.

FIG. 3 is a flowchart of an embodiment of the creation a postal indicium that incorporates a watermarked image. At 510, an image stored on an electronic device other than the printing device that will be used to print the postal indicium is analyzed by the electronic device to locate one or more watermarking zones. At 512, the electronic device performs one of a number of possible forms of transform on the image. At 514, the transformed image resulting at 512, and metadata conveying the one or more watermarking zones located at 510 are transmitted by the electronic device to the printing device that will be used to print the postal indicium. The electronic device may additionally transmit a piece of data to be used by the printing device to create a barcode and/or a watermark to the printing device. Alternatively, the electronic device may additionally transmit at least a portion of a barcode and/or a watermark to the printing device.

Figure 4:
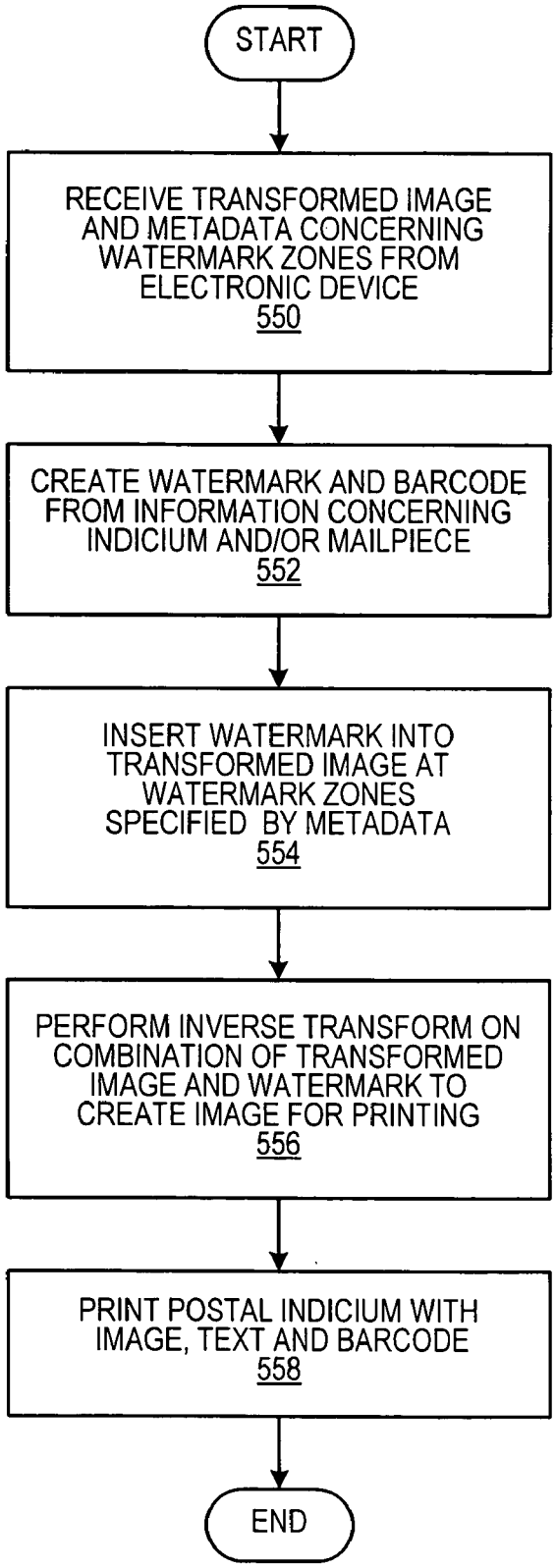
FIG. 4 is a flowchart of an embodiment of a method of creating and printing a postal indicium.

FIG. 4 is a flowchart of an embodiment of the creation and printing of a postal indicium that incorporates a watermarked image. At 550, a printing device receives a transformed image and metadata concerning watermarking zones within the transformed image from an electronic device. The transformed image is an image on which one of a variety of possible transforms has been performed by a device other than the printing device (as previously discussed) to prepare the image for the insertion of a watermark. The metadata specifies one or more watermarking zones within the transformed image into which portions and/or all of a watermark may be inserted by the printing device.

At 552, the printing device creates a watermark to be inserted into the transformed image and a barcode to be printed as part of the postal indicium. Various pieces of information are used in creating the barcode and the watermark, such as and without limitation, the pieces of information earlier discussed with reference to the barcode 310 and the watermark data 227. In some embodiments, the watermark may be created indirectly from such pieces of information by being derived from a barcode that encodes such pieces of information.

At 554, the printing device inserts the watermark (or one or more portions of the watermark) into the transformed image at the one or more watermarking zones specified by the metadata. In some embodiments, where more than one watermarking zone is specified, the watermark may be divided and differing portions of the watermark may be inserted at more than one of the watermarking zones. Alternatively, where more than one watermarking zone is specified, the entire watermark may be inserted at more than one of the watermarking zones.

At 556, the printing device performs a transform on the combination of the transformed image and the watermark to create an image for printing, wherein the transform performed by the printing device is the inverse of the transform originally performed by another device to create the transformed imaged. At 558, the postal indicium is printed, wherein the postal indicium incorporates the image resulting from the transform at 556, the barcode and human readable text.

While preferred embodiments of the invention have been described and illustrated above, it should be understood that these are exemplary of the invention and are not to be considered as limiting. Additions, deletions, substitutions, and other modifications can be made without departing from the spirit or scope of the present invention. Accordingly, the invention is not to be considered as limited by the foregoing description but is only limited by the scope of the appended claims.

What is claimed is:

1. A method of creating and printing an indicium incorporating a watermark, the method comprising:

storing a transformed image in a storage of a printing device;

storing metadata specifying at least one watermarking zone for the transformed image in the storage of the printing device;

inserting in the printing device at least one portion of the watermark into the at least one watermarking zone of the transformed image;

performing in the printing device a transformation of the transformed image with the at least one portion of the watermark inserted therein to create a printing image; and printing the indicium wherein the indicium incorporates the printing image.

2. The method according to claim 1, further comprising creating the watermark in the printer from at least one piece of information concerning the indicium, wherein the at least one piece of information changes each time an indicium is printed by the printing device.

3. The method according to claim 2, wherein the at least one piece of information is a time stamp indicating when an indicium is generated by the printing device.

4. The method according to claim 1, wherein the printing image is a company logo of a sender of a mailpiece.

5. The method according to claim 1, wherein the at least one watermarking zone is determined through analyzing a plurality of portions of an original image from which the transformed image is derived for relative complexity.

6. The method of claim 1, wherein the indicium is a postal indicium.

7. A printing device to print an indicium incorporating a watermark, comprising:

a print engine;

a storage having stored therein an inverse transform software; and a processor structured to:

store a transformed image in the storage;

store metadata specifying at least one watermarking zone for the transformed image;

insert at least one portion of the watermark into the at least one watermarking zone of the transformed image;

perform a transformation of the transformed image with the at least one portion of the watermark inserted therein to create a printing image; and print the indicium wherein the indicium incorporates the printing image.

8. The printing device according to claim 7, further comprising an interface and wherein the processor is further structured to receive the transformed image data through the interface from another electronic device on which a transform was performed on an original image to create the transformed data.

9. The printing device according to claim 7, further comprising an interface and wherein the processor is further structured to receive the metadata through the interface from another electronic device on which the metadata was generated by analyzing an original image that is transformed to create the transformed data.

10. The printing device according to claim 7, wherein the processor is further structured to create the watermark in the printer from at least one piece of information concerning the indicium, wherein the at least one piece of information changes each time an indicium is generated by the printing device.

11. The printing device according to claim 10, wherein the at least one piece of information is a time stamp indicating when an indicium is generated by the printing device.

12. The printing device of claim 7, wherein the indicium is a postal indicium.

13. A machine-readable non-transitory medium on which a sequence of instructions are stored that when executed by a processor of a printing device causes the processor to perform operations comprising:

storing a transformed image received from an electronic device in a storage of a printing device;

storing metadata received from an electronic device that specifies at least one watermarking zone for the transformed image in the storage of the printing device;

inserting at least one portion of the watermark into the at least one watermarking zone of the transformed image;

performing a transformation of the transformed image with the at least one portion of the watermark inserted therein to create a printing image; and printing an indicium that incorporates the printing image.

14. The machine-readable medium according to claim 13, wherein the operations further comprise creating the watermark from at least one piece of information concerning the indicium.

15. The machine-readable medium according to claim 14, wherein the at least one piece of information is a time stamp indicating when an indicium is generated.

16. The machine-readable medium according to claim 13, wherein the printing image is a company logo of a sender of a mailpiece.

17. The machine-readable medium according to claim 13, wherein the at least one watermarking zone is determined on the electronic device through analyzing a plurality of portions of an original image from which the transformed image is derived for relative complexity.

* * * * *